US005251924A

United States Patent [19]

Nussbaumer

[11] Patent Number: 5,251,924

[45] Date of Patent: Oct. 12, 1993

[54] SKI CONSTRUCTION INCLUDING WEDGE-SHAPED ATTACHMENT PORTIONS

[75] Inventor: Wolfgang Nussbaumer, Dornbirn, Austria

[73] Assignee: Kastle Aktiengesellschaft, Hohenems, Austria

[21] Appl. No.: 11,127

[22] Filed: Jan. 28, 1993

Related U.S. Application Data

[63] Continuation of Ser. No. 743,420, Aug. 22, 1991, abandoned.

[30] Foreign Application Priority Data

Dec. 22, 1989 [AT] Austria ..... 2921/89

[51] Int. Cl.[5] ..... A63C 5/07

[52] U.S. Cl. ..... 280/602; 280/610

[58] Field of Search ..... 280/602, 610, 607, 608, 280/609; 441/68

[56] References Cited

U.S. PATENT DOCUMENTS

| | | | |
|---|---|---|---|
| 4,221,400 | 9/1980 | Powers | 280/602 |
| 4,383,701 | 5/1983 | Hirnböck et al. | 280/610 |
| 4,697,820 | 10/1987 | Hayashi et al. | 280/602 X |
| 4,804,200 | 2/1989 | Kuchler | 280/602 |
| 4,895,388 | 1/1990 | Richmond | 280/602 X |
| 5,002,300 | 3/1991 | Pascal et al. | 280/602 |
| 5,026,086 | 6/1991 | Guers et al. | 280/610 X |

FOREIGN PATENT DOCUMENTS

| | | | |
|---|---|---|---|
| 286842 | 4/1970 | Austria . | |
| 351415 | 7/1979 | Austria . | |
| 378327 | 7/1985 | Austria . | |
| 380172 | 4/1986 | Austria . | |
| 380792 | 7/1986 | Austria . | |
| 383747 | 8/1987 | Austria . | |
| 386126 | 7/1988 | Austria . | |
| 3908683 | 10/1989 | Fed. Rep. of Germany . | |
| 8700763 | 2/1987 | World Int. Prop. O. | 280/602 |
| 8801189 | 2/1988 | World Int. Prop. O. | 280/602 |

*Primary Examiner*—Brian Johnson

*Attorney, Agent, or Firm*—Lorusso & Loud

[57] ABSTRACT

A ski with a core between a lower and upper strip layer over the entire length of the ski, with attached portions of lightweight material in front of and behind the ski boot support zone. The attached portions are glued to the upper strip layer. The ski is encased by a molded integral sheath of plastic material.

14 Claims, 3 Drawing Sheets

SKI CONSTRUCTION INCLUDING WEDGE-SHAPED ATTACHMENT PORTIONS

This is a continuation of copending application Ser. No. 07/743,420 filed on Aug. 22, 1991, and now abandoned.

BACKGROUND OF THE INVENTION

The invention relates in particular to a ski in which a sheath or casing of preferably elastomeric plastic material is molded on to the top side and the side surfaces of a ski blank, said ski blank usually comprising strip layers, core, outward sole and possibly steel edges.

A structural configuration of that kind for skis is known, in which the sheath or casing is usually integrally molded on to the rough ski, more specifically in a mold into which the rough ski is fitted, whereupon, after the mold is closed, the material of the sheath or casing is introduced into the remaining mold cavity which corresponds to the sheath or casing. A preferred configuration of that process is the RIM (Reaction Injection Molding) process by means of which polyurethane or components thereof, isocyanate and polyol, which are mixed together and with a dyestuff in the injection head, are injected into the mold cavity. Operation is generally effected using pressures (in the mold cavity) of between 2 and 15 bars. If, as is preferred, the result is to be an elastomeric polyurethane sheath, that can be achieved by virtue of the choice and adjustment of the components of the polyurethane.

The object of the present invention is in particular that of improving skis of the design configuration set forth in the opening part of this specification, more specifically above all in regard to the mechanical-dynamic characteristics of the ski.

Primarily the problem of the invention is that of substantially optimizing the bending characteristics of skis to eliminate harmful influences of the clamped ski boot on the bending characteristic.

SUMMARY OF THE INVENTION

In accordance with the invention, attachment positions of lightweight material disposed in front of and behind the boot support region, stand up relative to the boot support region and which are adhered to the layers of the ski and disposed beneath them and possibly above them, wherein the ski blank—at least from the core upwards—together with the attachment portions is jointly encased by the molded preferably one-piece sheath of plastic material.

The invention is based on the realization that in particular the bending characteristics of the ski are also influenced by the boot which is clamped to the ski in the ski binding, more specifically in the sense of producing a stiffening effect in the middle region of the ski, in which case the single-curvature, smooth, 'theoretical' bending characteristic of the ski alone (without the boot clamped thereto) is more or less deformed by virtue of the boot being clamped in position in the middle of the ski, that is to say it includes a 'stiffening hump' (see FIG. 11). The arrangement according to the invention now provides, as can be seen from the diagrammatic illustration of the bending characteristic in FIG. 12, that the apex region B' of the bending characteristic (in broken line) of the ski initially deliberately has respective maxima BM in front of and behind the boot support region, without a boot being clamped in position on the ski, but after the boot is clamped in position in the binding, those two maxima practically disappear, that is to say they are bridged over by a substantially smooth arcuate apex portion B of the bending characteristic, whereby the bending characteristic also generally, acquires a compensated arcuate smooth configuration and is thus optimized.

Admittedly ski design configurations have already been proposed which have raised portions in front of and behind the boot support region, but they do not involve measures for optimizing the bending characteristic when a boot is clamped in position thereon and, from the structure point of view, they also do not involve attachment portions which are encased by a common sheath of preferably elastomeric plastic material.

By virtue of the present invention, it is also possible to influence the oscillation characteristics and in particular the performance of the ski in terms of vibration damping, torsional characteristics and surface pressure distribution. A particular damping effect with respect to the attached portions also lies in the fact that transmission of the oscillations or vibrations of the ski to the foot or the leg of the skier are dampened, thus permitting the skier to ski with a lower level of fatigue. In a preferred fashion, the attached portions are arranged above the upper strip, in particular when the latter comprises metal, and are adhered to the upper strip directly or indirectly, that is to say with the interposition of one or more intermediate layers.

The attached portions are to be of the lowest possible density, for example between 0.1 and 0.6 g/cm$^3$. In that respect, consideration is given in particular to foam materials, including foam-fiber composite materials, or other lightweight materials (light woods, honeycomb core materials). The foam materials used may be for example closed-cell foam materials, which gives the advantage that the plastic material of the sheath, of greater specific weight, does not penetrate into the attached portions. Penetration of the plastic material of the sheath into the foam material of the sheath can also be prevented when using open-cell or hybrid-cell foam material if the surface of the attachment portions is lacquered or painted or a closed outside skin or surface is produced in some other way. On the other hand however, a certain degree of penetration of the plastic material of the sheath into the material of the attached portions may be advantageous in regard to joining the sheath and the attachment. In that case open-cell or hybrid-cell foam materials without a closed outside skin should be used.

As regards the shape of the attachment portions, they are desirably of a wedge-shape which rises towards the center of the ski. At any event it is desirable if the attached portions including the sheath material are of a structural height which rises towards the center of the ski. It will be appreciated that, when using attached portions which are not of a wedge-like configuration, the same effect could also be achieved by merely varying (increasing) the thickness of the sheath over the attachment portions, in a direction towards the center of the ski.

Parts of the ski binding may be connected to the attached portions or the sheath portions thereof, or may engage into the attached portions, at the end thereof (towards the boot support region). It is also possible however to mount commercially available binding members behind the front attachment portion and in front of the rear attachment portion, on the boot support region.

Preferably in the rearward part of the ski the top side of the sheath or of a separate surface covering, in particular also in the region of the attached portions, may have a longitudinal rib profile whereby it is possible to influence the torsional stiffness and the surface pressure distribution of the ski. The ribs act in the sense of providing an increase in torsional stiffness. In that way, with the same level of torsion, it is possible to choose a 'gentler' bending characteristic. The result is that, while the ski enjoys easier rotatability, stability in a curve is retained. The ski has excellent acceleration out of a curve. However that effect also occurs in relation to skis without additional attachment portions.

It is further possible for implements or compartments for implements to be molded into the surface covering or, in the case of a ski of the structural configuration set forth in the opening part of this specification, into the regions of the plastic sheath which form the ski surface, or for such implements or compartments to be inserted (glued) into recesses in the sheath. The implements or the compartments or recesses therefore may possibly also project into the attachment portions (that is to say if the ski has attached portions). The implements that fall to be considered are for example: a clock, a thermameter, a compass, a light, a reflector, an avalanche search transmitter or receiver, data carrier for the control of ski lift entrances, articles of value, keys ski passes, altimeters etc.

The sheath preferably comprises an elastomeric plastic material, for example polyurethane, wherein the plastic material of the sheath is preferably molded on to the rough ski using the above-mentioned RIM-process. In that connection the entire sheath of the ski may comprise a unitary plastic material or it may comprise in a zone-wise manner different plastic materials (multi-component coating), in which case however the zones of different plastic materials positively hold together in terms of the materials involved.

BRIEF DESCRIPTION OF THE DRAWING

The invention is described in greater detail hereinafter by means of an embodiment with reference to the drawings in which.

DETAILED OF DESCRIPTION OF THE INVENTION

Figure 3:
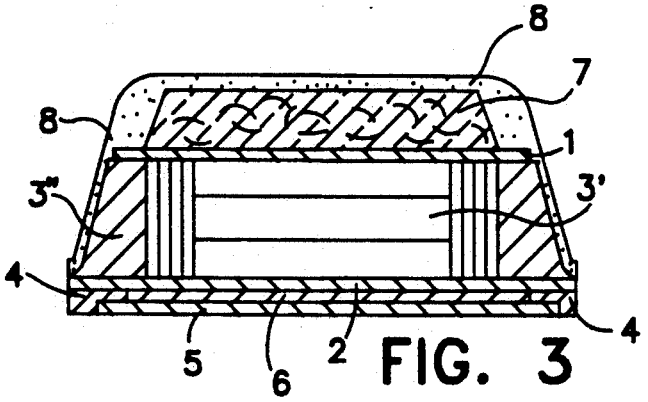
FIG. 3 is a view in cross-section taken along line III—III in FIG. 1.
Figure 4:
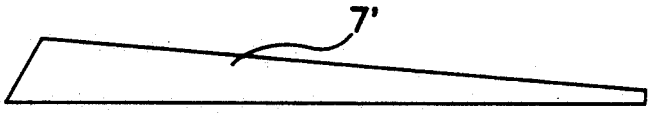
FIGS. 4 through 6 show an attached portion for the rear-ski in elevation (FIG. 4), in plan view (FIG. 5) and in transverse elevation (FIG. 6)
Figure 5:
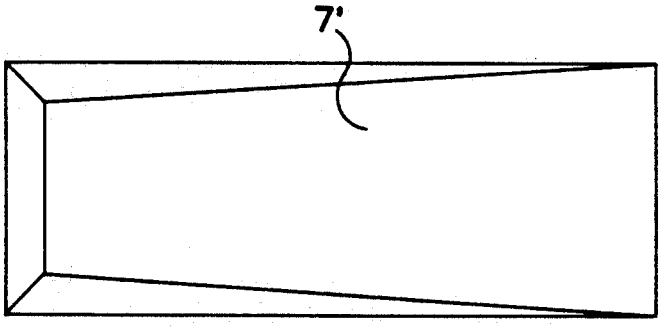
Figure 6:
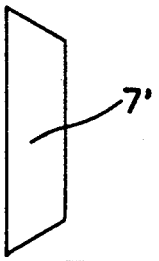
Figure 7:
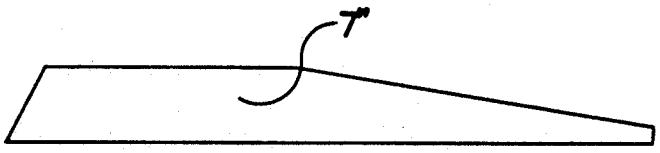
FIGS. 7 through 9 show an attachment portion for the fore-ski in elevation (FIG. 7), in plan view (FIG. 8) and in transverse elevation (FIG. 9)
Figure 8:
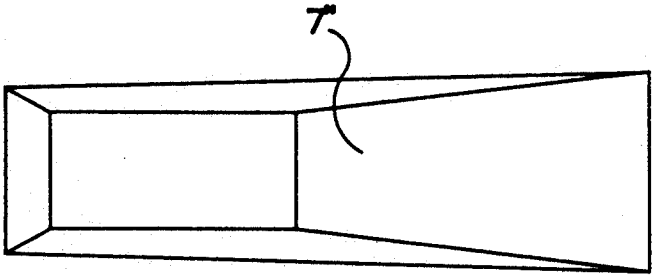
Figure 9:
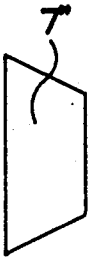
Figure 10:
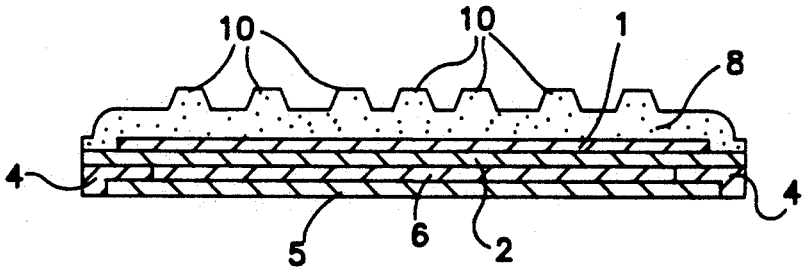
FIG. 10 is a view in cross-section taken along line X—X in FIG. 1.
Figure 11:
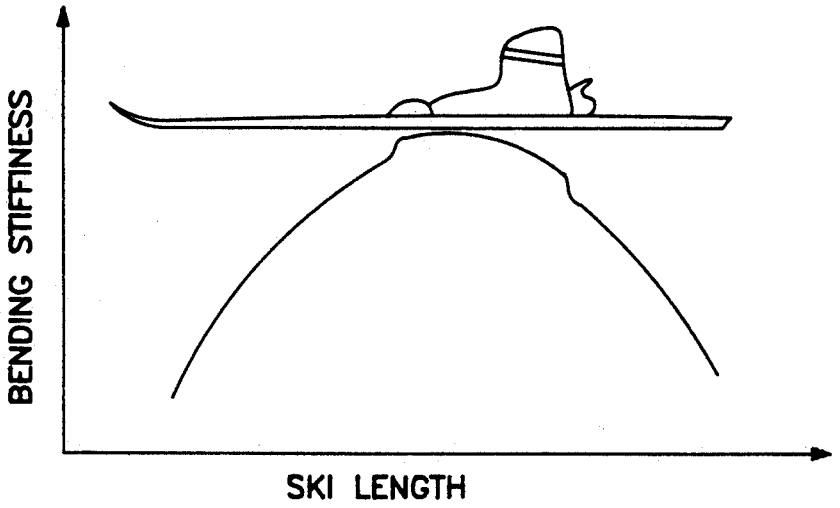
FIG. 11 is a diagrammatic bending characteristic diagram of a ski with non-optimised bending characteristic.
Figure 12:
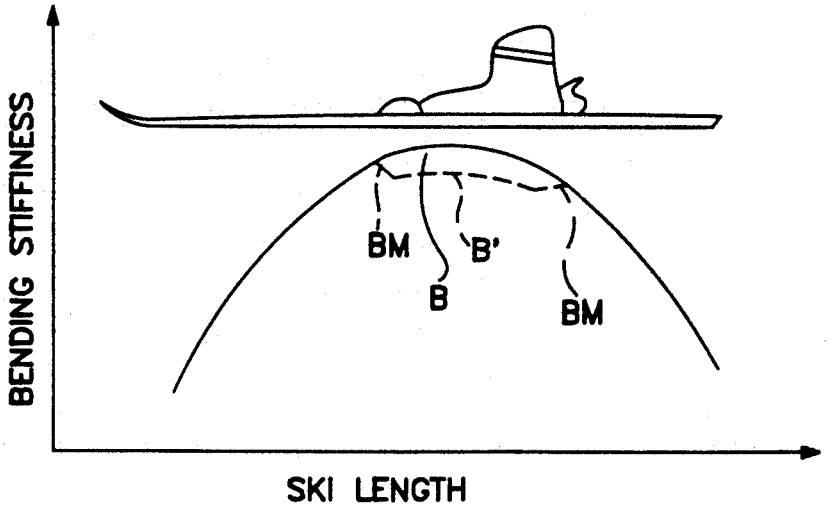
FIG. 12 shows the optimisation effect of the bending characteristic in accordance with the invention, by means of a diagrammatic bending line diagram.

The illustrated embodiment concerns an Alpine ski which, as can be seen in particular from the cross-sectional views of FIGS. 3 and 10, comprises the following components: the upper strip 1 and the lower strip 2, for example of lightweight metal or alloy, the core with a central portion 3', for example of wood, and side portions 3'', for example of foam, the steel edges 4 and the outward sole 5 as well as a compensating layer 6 between the sole 5 and the lower strip 2 (which layer may also comprise load-bearing material, for example glass fiber laminate).

In accordance with the invention, an attached portion 7 of lightweight material, for example foam, is added to the above-indicated conventional structure of an Alpine ski. The individual components of the ski are adhered together and foam the rough ski which is introduced into a mold and encased with a molded sheath or casing 8 of elastomeric plastic material, for example polyurethane, preferably using the RIM-process. The adhering of the individual components of the rough ski may be effected by means of adhesive materials and/or on the basis of the adhesion properties enjoyed by the materials of individual components in the state for processing thereof, or by fusing. Surface adhesion or a fusion effect also occurs between the material of the sheath and the components of the rough ski. In addition the material of the sheath may 'mechanically' lock into pores and recesses in the encased components.

Figure 1:
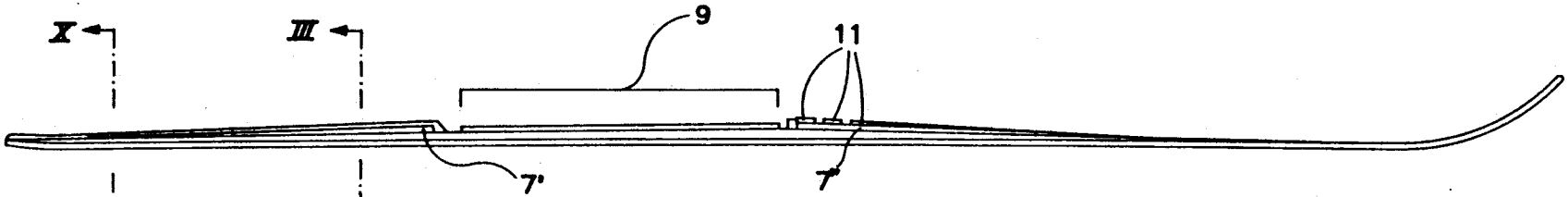
FIG. 1 is a partly sectional side view of a ski.

As can be seen from FIG. 1, arranged in front of and behind the boot support region 9 are respective wedge-shaped attached portions 7' and 7''. A configuration of the attached portions which is given by way of example is shown in FIGS. 4 through 9 in which the dimensional relationships of height, width and length are distorted. In practice, in relation to the illustrated height of the attached portions of for example 8 mm (rear attached portion 7', FIGS. 4 through 6) or for example 10 mm (front attached portion 7'', FIGS. 7 through 9), the width will be somewhat greater (rear attached portion 7' for example 58 mm, front attached portion 7'' for example 55 mm) and the length will be considerably greater (rear attachment portion for example 230 mm, front attached portion for example 240 mm). In the case of the rear attached portion 7' the width of the top side decreases towards the center of the ski (with the width of the base surface of the attached portion remaining the same), while in the case of the front attached portion 7'' both the width of the top side and also the width of the bottom surface decrease towards the center of the ski. The side surfaces and end surfaces of the attached portions 7', 7'' are inclined to diverge in a downward direction.

Figure 2:
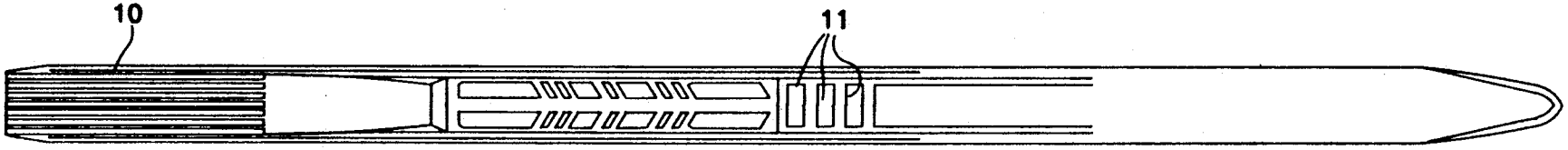
FIG. 2 is a plan view of the ski.

The sheath 8 of elastomeric plastic material also encloses the attached portions 7', 7''. As can be seen from FIGS. 2 and 10, at the surface of the rear-ski, the sheath 8 may have a rib profile comprising a plurality of parallel upstanding ribs 10 which extend in the longitudinal direction of the ski, while the ribs 10 may also extend over regions of the sheath below which there is an attached portion 7'. The height and width of the ribs is of the order of magnitude of some millimeters. In the illustrated example (FIG. 2) the ribs 10 extend over a length of about 20% of the ski length. It is also possible for other portions or lengthwise regions of the sheath of the rear-ski and/or fore-ski to be provided with a rib profile.

In addition, implements or compartments for implements may be molded into the sheath 8, now preferably at the fore-ski or recesses for receiving implements or the compartments may be hollowed out. The implements, compartments or recesses are identified by reference numeral 11 in FIGS. 1 and 2. The implements or the compartments therefore or the recesses may also extend into the attached portion 7" which is beneath the sheath 8. The recesses are lined by the plastic material of the sheath 8.

In the illustrated embodiment the attachment portions 7 or 7', 7" are arranged above the upper strip 1. That is the preferred embodiment in which in particular the effect of optimization of the bending characteristic is clearly pronounced. It would also be possible however, in particular if the upper strip is made from a fiber-plastic laminate (prepreg) for the attached portions to be arranged beneath the upper strip, namely on the top side of the core, but in particular on the top side of an intermediate strip which is disposed above the core.

What is claimed is:

1. A ski comprising a ski body including a core interconnecting a lower strip and at least one upper strip, said lower strip and at least one upper strip extending substantially over the entire length of the ski, a running surface connected beneath said lower strip and running edges connected on lateral sides of said running surface, attached portions of lightweight material being arranged in front and behind a ski boot support region and standing up relative to said ski boot support region, said attached portions being glued to an uppermost of said at least one upper strip, said ski body and said attached portion being jointly encased by a molded integral sheath of plastic material, said sheath covering top, side and end surfaces of said attached portions and of said ski body.

2. The ski as set forth in claim 1 wherein said attached portions are glued to said uppermost strip with an interposition of at least one intermediate layer between said attached portions and said uppermost strip.

3. The ski as set forth in claim 1 wherein said sheath is comprised of elastomeric plastic material.

4. The ski as set forth in claim 1 wherein the total structural height of said attached portions and said sheath rises towards a center of the ski.

5. The ski as set forth in claim 1 wherein said attached portions are wedge shaped, the wedge rising towards a center of the ski.

6. The ski as set forth in claim 1 wherein the width of the attached portions decreases towards a center of the ski.

7. The ski as set forth in claim 1 where at least the width of a top side of the attached portions decreases towards a center of the ski.

8. The ski as set forth in claim 1 wherein the side surfaces of the attached portions, diverge in a downward direction.

9. The ski as set forth in claim 1 wherein end surfaces of the attached portions, diverge in a downward direction.

10. The ski as set forth in claim 1 wherein the attached portions comprise a foam fiber composite material.

11. The ski as set forth in claim 1 wherein said attached portions comprise a lightweight material of a density of between 0.1 and 0.6 g/cm$^3$.

12. The ski as set forth in claim 1 wherein a region of the sheath which embraces the attached portions diverge in a downward direction.

13. A ski as set forth in claim 1, wherein a top side of said sheath has a rib profile, which extends over a portion of the length of the ski and which comprises a plurality of ribs extending in the longitudinal direction of the ski, said plurality of ribs extending at least in part along regions of the sheath which cover attached portions.

14. A ski including a ski body comprising a core interconnecting a lower strip and at least one upper strip extending substantially over the entire length of the ski, a running surface connected beneath said lower strip and running edges connected on lateral sides of said running surface wherein utensil compartments are provided in a top surface plastic material partly encasing said ski body, wherein attached portions of the ski body are arranged in front and behind a ski boot support region and stand up relative to said ski boot support region, said ski body and said attached portions being jointly encased by a molded integral sheath of plastic material, said sheath covering top and side surfaces of said attached portions and of said ski body and wherein the utensil compartments project into said attached portions.

* * * * *